US005708939A

United States Patent [19]

Oikawa et al.

[11] Patent Number: 5,708,939

[45] Date of Patent: Jan. 13, 1998

[54] DEVELOPING APPARATUS AND PROCESS FOR AN ELECTROPHOTOGRAPHIC PROCESS

[75] Inventors: Akiko Oikawa, Hitachinaka; Toshiya Satoh; Toru Miyasaka, both of Hitachi, all of Japan

[73] Assignee: Hitachi. Ltd., Tokyo, Japan

[21] Appl. No.: 438,491

[22] Filed: May 10, 1995

[30] Foreign Application Priority Data

May 16, 1994 [JP] Japan ..... 6-100442

[51] Int. Cl.[6] ..... G03G 15/08

[52] U.S. Cl. ..... 399/252; 399/258

[58] Field of Search ..... 355/200, 245, 355/251, 260; 118/653, 656, 657, 658; 222/DIG. 1; 430/107; 399/222, 252, 254, 255, 256, 258

[56] References Cited

U.S. PATENT DOCUMENTS 3,389,863 6/1968 Eichorn et al. .

3,618,867 11/1971 Berlier ..... 222/DIG. 1 X 4,241,695 12/1980 Salger .

4,331,754 5/1982 Stephan .

4,391,503 7/1983 Pugh .

4,595,277 6/1986 Maczuszenko et al. .

4,637,340 1/1987 Thompson et al. .

5,177,323 1/1993 Kohyama .

5,331,381 7/1994 Ota et al. .

*Primary Examiner*—Sandra L. Brase

*Attorney, Agent, or Firm*—Antonelli, Terry, Stout & Kraus, LLP.

[57] ABSTRACT

An image forming apparatus for an electrophotographic process utilizes an agglomerate of toner powder so as to avoid scattering of toner powder. When the agglomerate is crushed or de-agglomerated to fine toner powder, only toner powder having a proper particle size for electrophotography is selected by a mesh member through which the toner must pass. The process can be utilized for a single component toner developing system and a component toner developing system.

30 Claims, 3 Drawing Sheets

DEVELOPING APPARATUS AND PROCESS FOR AN ELECTROPHOTOGRAPHIC PROCESS

BACKGROUND OF THE INVENTION

Field of the Invention

This invention is related to an image forming apparatus utilizing an electrophotographic process and an electrophotographic process. In particular, this invention is related to an image forming apparatus having a developing unit which uses toner agglomeration in the supply of toner for visualization of an electrostatic latent image.

In an image forming apparatus utilizing an electrophotographic process, an electrostatic latent image formed on a photoconductor is visualized by an image forming substance called a toner. Generally, the toner is made up of colored fine particles having a particle size of 5–20 microns. For this reason, the toner is easily scattered. In handling the toner, the human body and the environment are often polluted by the toner supplied to the developing unit. Accordingly, handling of the toner is recommended.

In particular, in recent years, the use of small particles of toner is required for obtaining high image quality. However, this produces a tendency that scattering of the toner powder is more apt to occur. A method which makes handling of the fine particle toner easier was proposed to solve the problem mentioned above. For example, in Japanese utility model patent publication No. 4-52758, a toner supplying method using a toner cartridge is disclosed.

In the method mentioned above, the toner is accommodated in a container detachably installed in a developing unit. At the time of mounting the container into the developing unit or after mounting of the container, the supplying of the toner to the developing unit is carried out by opening an aperture in the cartridge sealed by a seal member.

And, in Japanese patent publication No. 51-9533, a method is disclosed in which toner molding is performed by agglomerating a fine particle toner by pressure and heating. A method of toner molding is mentioned in this patent. Fine particle toner is molded under a pressure of 5–50 kg/cm2 or is thermally agglomerated by heating to a temperature by 20°–50° C. lower than the softening point of the toner. The molded toner can be restored by mixing it with a carrier in the developing unit of a two component toner system used in a conventional electrophotographic method.

The method using the toner cartridge mentioned above brings about a scattering of the toner or over-flowing of the toner at the connecting part between the cartridge and the developing unit. And, there is the high possibility that this will produce a bad influence on the internal and external environment of the image forming apparatus. Residual toner in the container overflows or scatters from the opening at the time of withdrawing of the cartridge or during handling of the cartridge, so that a users' hands and clothes may be polluted. Because there is a need for replacement of old cartridges in the supplying of toner, the maintenance cost of the apparatus becomes high.

On the other hand, the problem of toner scattering is solved by the method the handling of toner as a lump of fine particles. As is disclosed in Japanese patent laid-open print No. 4-178657 bulletin, it is difficult to recover the lump of toner to the original toner fine particle size only by stirring the lump and carriers in the two component developing unit, because an insufficiently de-agglomerated lump will usually remain after stirring.

SUMMARY OF THE INVENTION

An object of this invention is to provide an image forming apparatus having a developing unit which is capable of forming stable images even when employing agglomeration of the toner to make it easy to handle and is free of problems such as toner scattering.

According to the present invention, the above mentioned object is accomplished by a developing unit comprising; a photoconductor, a charger for uniformly charging the surface of the photoconductor, an exposer for forming a latent electrostatic image on the surface of the photoconductor, and a developing unit for visualizing the latent image by causing toner to adhere to the latent image, wherein the developing unit comprises de-agglomerate means for de-agglomerating the toner agglomerate to a fine toner powder. Another aspect of the present invention resides in a developing unit comprising a de-agglomeration chamber which has means for de-agglomerating a toner agglomerate, supply means for supplying toner agglomerate to the de-agglomeration chamber, classifying means for selecting or classifying toner having a particle size suitable for the developing unit from de-agglomerated toner particles in the de-agglomeration chamber and a developing agent bearing member for conveying classified toner to an electrostatic latent image bearing member. By constituting the developing unit as mentioned above, the agglomerated toner is de-agglomerated or crushed or ground by the de-agglomerator, and the ground toner that contains toner particles having the original toner particle size is classified by the classifying member to select toner particles suitable for development. The present invention also provides an electrophotographic process, which comprises preparing an agglomerate of toner powder; supplying the agglomerate to a developing unit; and de-agglomerating the agglomerate to produce a toner powder having a particle size usable for developing a latent image on a photoconductor.

Therefore, a stable image formation using the toner agglomeration whose handling is easy becomes possible.

DETAILED DESCRIPTION OF THE PREFERRED EMBODIMENTS

In the following, the present invention will be explained in detail by reference to various examples. The quantity of each ingredient mentioned in each example is referred to as parts by weight.

Figure 1:
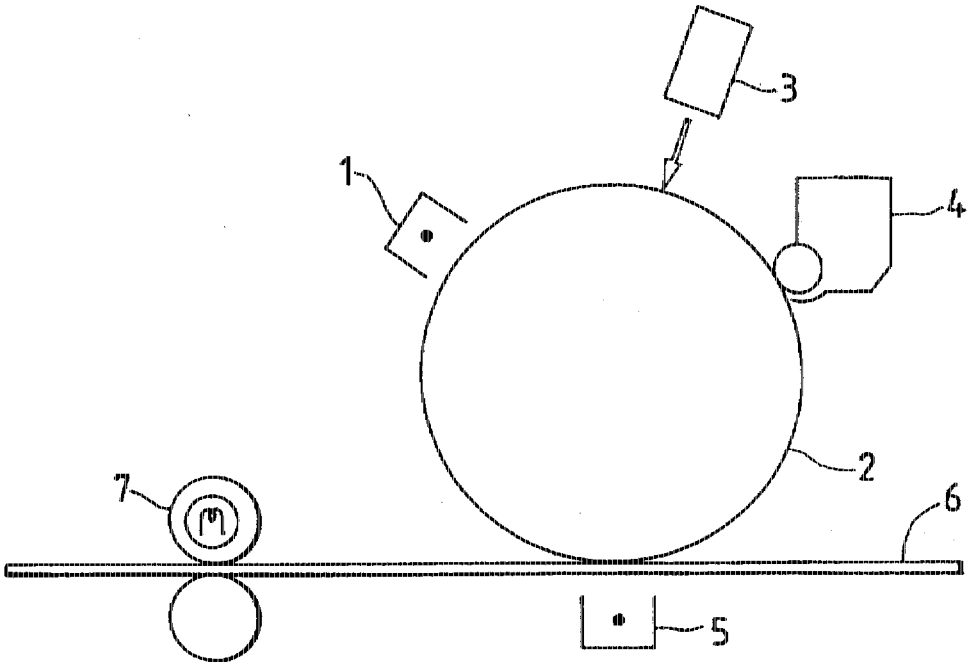
FIG. 1 is a diagram of an example of the image forming apparatus of this invention.

FIG. 1 is a drawing showing an example of the construction of an image forming apparatus of the type to which the present invention is directed. By a signal from a control section which is not illustrated, a predetermined quantity of charge is applied by charger 1 to the surface of photoconductor drum 2 substantially homogeneously. Subsequently, exposure device 3 is driven in response to a control signal from the control section according to image information input from the outside so that the surface of the photoconductor drum 2 is exposed with light in a pattern indicated by the image information.

Charges on the selected portions of the photoconductor disappear by exposing the portions to light so as to form an electrostatic latent image.

Subsequently, the latent image formed on photoconductor drum 2 is visualized by toner which is charged with a reverse polarity and is accommodated in a developing unit 4.

Then, the visual image is transferred by transfer unit 5 onto a recording medium 6 such as paper or plastic sheet, and is heated to fix the visual image on the medium using a fixing device 7.

Toner that forms the toner agglomeration used in the present invention is one used for conventional electrophotography. The toner should contain at least one kind of resin and a coloring agent. For example, an average particle size of 1–20 microns, and more preferably an average particle size of 5–10 microns is useful.

As a resin for the toner, the following examples are resins used for conventional toners.

Homopolymers of styrene or the substituents; polystyrene, poly-p-chlorostyrene, poly vinyltoluene Styrene series copolymers; styrene-p-chlorostyrene copolymer, styrene-propylene copolymer, styrene-vinyltoluene copolymer, styrene-vinylnaphthalene copolymer, styrene-methylacrylate copolymer, styrene-ethylacrylate copolymer, styrene-butylacrylate copolymer, styrene-methyl-metacrylate copolymer, styrene-ethylmetacrylate copolymer, styrene-butylmetacrylate copolymer, styrene-alpha-methyl chlorometacrylate copolymer, styrene-acrylonitorile copolymer, styrene-vinylmethylether copolymer, styrene-vinylmethylketon copolymer, styrene-butadiene copolymer, styrene-isoplene copolymer, styrene-acrylonitorile-indene copolymer Polyvinylchrolide;

Polyvinylacetate;

Polyethylene;

Polypropylene;

Silicone resin;

Polyester resin;

Polyurethane resin;

Polyamide resin;

Epoxy resin;

Polyvinylbutyrale;

Rosin modefied resin;

Terpene resin;

Phenol resin;

Xylene resin;

Aliphatic hydrocarbon resin;

Alicyclic hydrocarbon resin;

Aromatic series petroleum resin;

Chlorinated paraffin;

Paraffin wax;

Materials mentioned above are used singly or as mixtures of two or more kinds of materials. And, resins which are partially cross-linked by a conventional cross-linking agent, such as divinylbenzene, can also be used.

There are resins having a molecular structure with active points such as hydroxyl groups or carboxyl groups where polymerization reaction of the monomers takes place by energization from the outside, such as heat or mechanical pressure. As the active points, there are double bonds, such as vinyl groups, besides the functional groups, such as a hydroxyl group and carboxyl group.

Conventional coloring agents as used in conventional electrophotography may be used without limitation. For example, carbon black used for monochrome and nigrosine dyes are useful. Further, there are the following dyes or pigments.

Azo dyes; C.I. solvent yellow 2, 14, 16, 19, 60, C. I. Solvent red 3, 8, 24, 27

Anthraquinone dyes;

Indigo dyes;

Phthalocyanine dyes;

Quisantoine dyes; C. I. Solvent red 48, 49

Azo pigments; C. I. pigment yellow 12, C. I. pigment red 48, 81, C.I. pigment green 4

Benzimidazolone pigments; C. I. pigment red 185

Quinacridone pigments; C. I. pigment red 122, 207, 209

Phthalocyanine pigments; C. I. pigment blue 15, C.I. pigment green 7

Isoindorinone series pigments; C. I. pigment yellow 109, 173

Isoindorine series pigments; C. I. pigment yellow 139

Dioxadine pigments; C. I. pigment violet 23

Anthraquinone pigments; C. I. pigment yellow 108; C. I. Pigment red 177, C. I. Pigment blue 6

Perylene pigments; C. I. pigment red 178

Perynone pigments; C. I. pigment orange 43

Thioindigo pigments; C. I. pigment violet 38

Quinophtalone pigment; C. I. pigment yellow 133

Metal complex pigments; C. I. Pigment yellow 153

Inorganic series pigments; titanium oxide, carbon black, molybdenum red, chromium yellow, titanium yellow, chromium oxide, Berlin blue Metal powder; aluminum powder These coloring agents may be added in an amount of 0.1–10 parts by weight per 100 parts by weight of the resin.

Charge control agents, flow-assisting agents, fixing promotion agents and electroconductive agents may be added to the toner composition, if necessary. The conventional charge control agents for electrophotography are used without limitation. For example, there are the following substances for negative charge toners: metal chelates of alkyl salicylic acid, metal chelates of dicarboxylic acid, polycyclic salicyclic acid metal salts, azo metal dyes, chlorinated paraffin, and chlorinated polyester.

And, there are the following substances for positive charging toners:

nigrosine series dyes, aliphatic metal salt, quaternary ammonium salt, benzothiazole derivatives, guanamine derivative, and dibutyltine oxide.

These charge control agents may be used singly or in combination. A quantity of the addition is 0.1–10 parts by weight per 100 parts by weight of the resin.

Flow-assisting agents are amorphous silica, Teflon fine powder, and zinc stearate powder, for example. These flow-assisting agents may be used singly or in a mixture of two or more kinds, which is added in an amount of 0.1–10 parts by weight per 100 parts by weight of the resin.

As fixing promotion agents, there are low softening point compounds such as the following.

Waxes, paraffin wax, low molecular weight polyolefin, low molecular weight polyethylene or low molecular weight polypropylene. These fixing promotion agents may be used singly or as a mixture of two substances two or more kinds. The quantity of the addition is 0.1–10 parts by weight per 100 parts by weight of the resin. There are electroconductive metal oxides such as titanium oxide, aluminium oxide, magnetite as the electroconductive agent. These electroconductive agents may be used singly or in a combination of two or more of the oxides, and they are added in an amount of 0.1–10 parts by weight per 100 parts by weight of the resin.

In the toner agglomeration used in this invention individual toner particles adhere to agglomerate by weak power, such as intramolecular force, van der Waals force, etc. The agglomerate should be divided or de-agglomerated by a weak force. When a total volume of a void in the unit volume of agglomerate is a void fraction $\epsilon$ (%), the void fraction should be of 5–80%, preferably 20–70%, most preferably 40–60%. When the void fraction exceeds 80%, toner particles do not agglomerate. And, the following methods may be employed as a production method for toner agglomeration.

a. A method of making an agglomerate by compressing toner b. A method of effecting thermal agglomeration by maintaining toner to a temperature lower than the softening point of the toner.

c. A method of making toner lumps of indefinite shapes by a chemical treatment with bridging or sticking phenomenon The obtained toner agglomeration is de-agglomerated by a de-agglomerator to be mentioned later. But, in a de-agglomeration chamber, coarse particles and minute particles co-exist. Such toner can not be used as it is. In accordance with this invention, a classifying member is utilized to classify the de-agglomerated toner, which is substantially equal to the particle size of original toner before agglomeration.

On the other hand, an ultra-fine powder of a diameter of several tens of microns my be produced. Such ultra-fine toner particles are improper for developing process. Although the quantity of the ultra-fine toner is very small, there may be a possibility that the charging property, cleaning property, etc. may become degraded after a long period of operation of the developing unit. These problems may be eliminated by use of separation means for the ultra-fine toner particles.

The shapes of the toner agglomerates used in this invention are not limited. For example, a plate-form lump, a lump of rod-form and an indefinite-form lump may be used.

Subsequently, the developing unit 4 of FIG. 1, as used in the present invention will be explained. There is a single toner component development method in which only toner is used as a developing agent.

Another developing method, which is called a two toner component method, uses an electroconductive substance called a carrier. In this method, toner is carried by sticking to the carrier.

At first, a developing unit using the single component development method will be explained.

Figure 2:
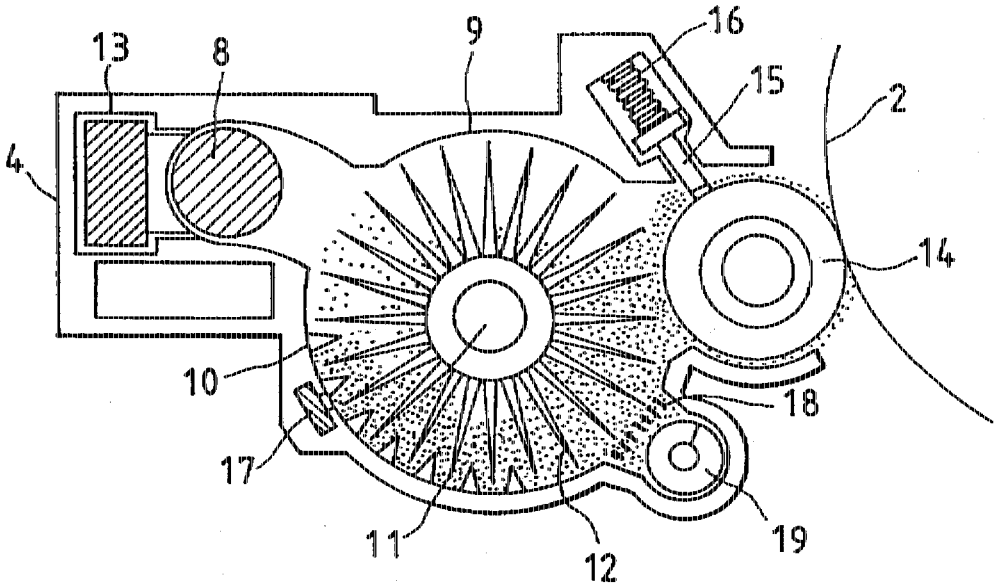
FIG. 2 is a diagram of an example of the developing unit which uses a single component toner developing system.

FIG. 2 is a diagrammatic horizontal sectional view of an example of a developing unit using the single component toner developing system of the present invention. Construction of the toner composition used in this example is set forth in the following.

| | |
|---|---|
| Bisphenol A polyester resin | 100 parts by weight |
| (Mw = 12,000, Mw/Mn = 8.9, Tg = 56 degrees centigrade, Tm = 100 degrees centigrade) | |
| Carbon black | 5.0 parts by weight |
| Nigrosine derivative | 1.0 parts by weight |
| Chromium chelate | 4.0 parts by weight |
| Silicone oil | 5.0 parts by weight |
| Low molecular weight polypropylene | 5.0 parts by weight |

Mw is a weight average molecular weight.

Mn is a number average molecular weight.

Tg is a glass transition temperature.

Tm is a softening temperature.

The toner composition shown above was subjected to pre-mixing, melt-mixing, coarse crushing, and fine grinding. The particle size of the obtained toner was measured by a coaltar counter. The particle size of 95% of the toner was 8–11 microns, and an average particle size was about 10.3 microns. 2 Parts by weight of toner was put in a cylindrical container having a diameter of 30 mm. Subsequently, toner was compressed under a pressure of 100 kg/cm2 by a hydraulic compression machine to produce a disk-form toner agglomerate 8 having a diameter of 30 mm and a thickness of In FIG. 2, the developing unit 4 has a de-agglomerator comprising projections 10 disposed therein and a comb like rotating body 11. The projections 10 are arranged on an inner wall of the de-agglomeration chamber 9 of the toner agglomerator; although, such projections are not always necessary. De-agglomerated toner 12 is accommodated in the de-agglomeration chamber 9. Developing unit 4 has supply means 13 for supplying toner agglomerate 8 to de-agglomeration chamber 9 and a developing roll 14 that serves as a developing agent carrier member.

Regulation blade 15 for controlling the quantity of toner on the developing roll 14 is controlled by pressurizing means 16. On the opposite side of the chamber 9 from the developing roll 14, detection means 17 for detecting the quantity of toner accommodated in de-agglomeration chamber 9 is installed.

Toner agglomerate supplied by supply means 13 to de-agglomeration chamber 9 is stirred and crushed by rotation of the comb like rotating body 11. Toner de-agglomerated by comb like rotating body 11 and restored to the original particle size of the toner is supplied in the direction of the developing roll 14 by the comb-like rotating body 11. De-agglomerated toner is charged by friction power acting on the toner and the comb like rotating body 11.

In the toner agglomerate de-agglomeration chamber 9, an inner wall of the chamber 9 is located at a position close to the comb like rotating body 11 so that de-agglomerate 8 is easily crushed or de-agglomerated. By such construction, toner agglomerate 8 is de-agglomerated rapidly and homogeneously in de-agglomeration chamber 9.

In the construction of FIG. 2, when projection 10 are disposed on the inner wall of de-agglomeration chamber 9, the de-agglomeration effect improves. While the comb-like rotating body rotates, toner supplied in a direction of the developing roll 14 is regulated by regulation blade 15.

Toner is further friction-charged by regulation blade 15. Thus, a homogeneous toner thin film is formed on the developing roll 14. A toner lump that is not de-agglomerated to a sufficiently enough small particle size to pass the regulation blade 15 drops by gravity and the toner lump is further crushed in de-agglomeration chamber 9. In the construction of FIG. 2, the regulating blade 15 may be disposed so as toward be directed to the downstream side of the rotating direction of the developing roll 14 or the regulation blade may be directed toward the center of developing roll 14 with an inclined angle.

By such construction, an insufficiently de-agglomerated toner lump easily drops without clogging between regulation blade 15 and developing roll 14. Developing roll 14 is of an electroconductive roll. Toner is absorbed by the roll 14 to which a voltage is applied. In the construction of FIG. 2, for collection of ultra-fine powder, there are installed a collection roll 19 for ultra-fine powder and a classifying member 18. Collection roll 19 for ultra-fine powder is screw type roll which operates to convey ultra-fine toner to an discharging port, which is not illustrated.

As mentioned above, due to the fact that a roll for collection of ultra-fine powder and sieve means are installed in the developing unit 4, a grain size distribution of toner can be recovered to the condition before agglomeration. A thin layer of toner formed on the developing roll 14 is conveyed with rotation of the developing roll 14 to the developing area where the photoconductor drum 2 and the developing roll 14 are opposed to each other. A voltage is applied to developing roll 14 to develop an electrostatic latent image maintained on the photoconductor drum 2 in the developing nip, the position where photoconductor drum 2 and developing roll 14 are opposite to each other.

Figure 3:
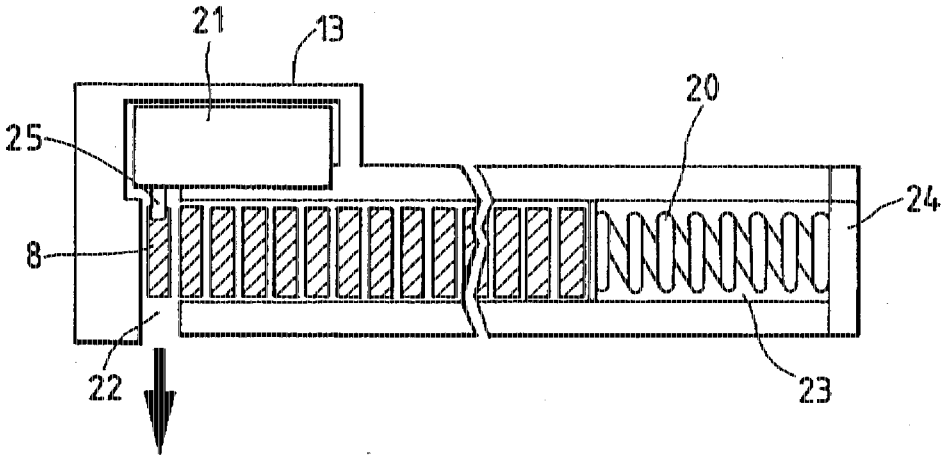
FIG. 3 is a diagram of supplying means for supplying agglomerated toner used for a single component toner developing system.

FIG. 3 is a top view of the toner agglomeration supply means 13 used in FIG. 2. Supply means 13 for the toner agglomerate is provided with a spring member 20 serving as bias means for several toner agglomerate blocks 8 stored in the supplying means 13. Supply means 13 is further provided with toner agglomerate transfer means 21 to transfer agglomerate blocks 8 one-by-one into de-agglomeration chamber 9. Toner agglomerate supply means 13 has an openings 22 through which the toner agglomerate blocks 8 are supplied to de-agglomeration chamber 9 from the storage space 23 for toner agglomerate blocks 8 in the toner supply means 13. Toner agglomerate storage space 23 is normally covered with lid 24 that supports one end of the spring member 20, the opening to the storage space 23 normally being maintained closed.

Information from detection means 17 concerning the toner quantity 9 is input into the control section. When a quantity of the toner reaches a lower limit, the toner agglomerate transfer member 21 operates a pusher. Toner agglomerate transfer member 21 opeartes a pusher 25 in response to the information from the control section, thereby to supply a predetermined amount of toner agglomerate in the form of a toner block to toner de-agglomeration chamber 9 through supplying opening 22. Supply of toner agglomerate blocks 8 to toner agglomerate supply means 13 is carried out easily through toner agglomerate supply opening 23 by detaching lid 24. Supply means 13 of toner agglomerate may be formed into a unit.

With this developing unit 4, a printing test was carried out. As a result, though coarse particles larger than 20 microns were present in de-agglomeration chamber 9 at a ratio of 60%, over 95% of the toner particles transferred to the surface of the developing roll 14 were 8 to 11 microns, which was close to the grain size of the toner before agglomeration. Obtained images were clear. The supplying of toner agglomeration blocks 8 to supply means 13 was very easy and toner scattering did not occur.

Figure 4:
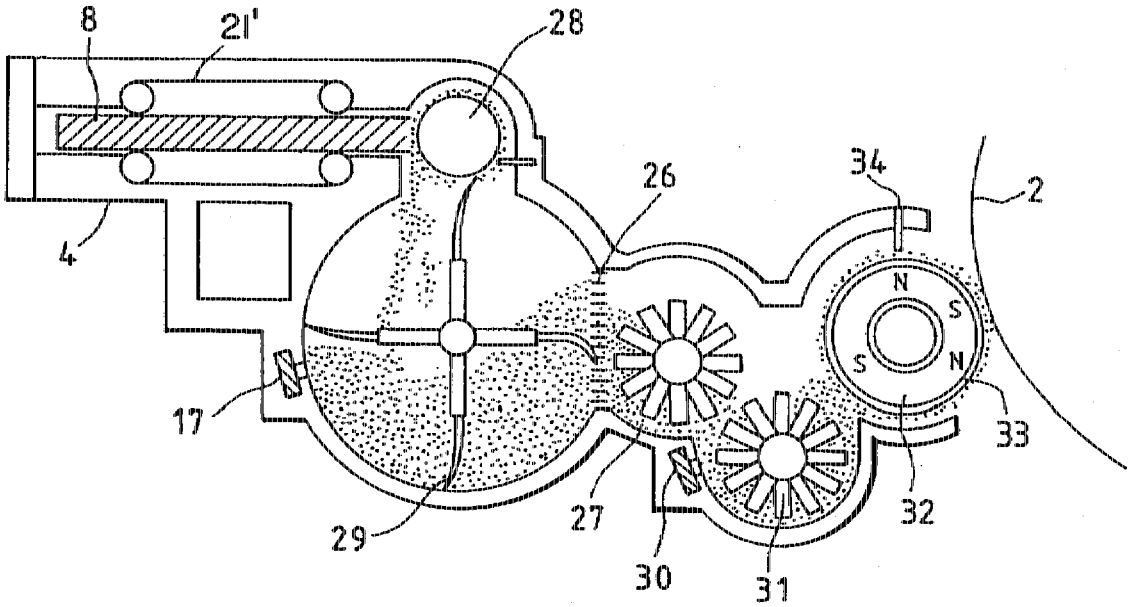
FIG. 4 is a diagram of an example of a developing unit which uses a two component toner developing system.

FIG. 4 is a schematic horizontal sectional view of an example of a developing unit using the two toner component toner developing system of the present invention. 50 Parts by weight of toner powder was filled in a container 2 cm long, 20 cm wide, and 2 cm high. Subsequently, with a hydraulic compression machine, the toner powder was compressed under a pressure of 100 kg/cm2 to produce a toner agglomerate block 8 of rod-form, 2 cm×2 cm×20 cm. Subsequently, the agglomerate was mixed with a ferrite carrier having an average particle size of 100 microns to prepare a mixture of a toner concentration of 3.3% by weight.

In the construction of the device shown in FIG. 4, the inside of the developing unit 4 is partitioned by classifying member 26, which serves as a toner supplying opening into de-agglomeration chamber 9 and developing agent storage section 27 for the developing agent containing toner and a carrier. As to classifying member 26, it should have a mesh diameter which passes toner particles useful for the developing. For example, a preferable mesh is ASTME11-58T2500 to 625, and a more preferable mesh is 2500–1250 mesh.

Rotation member 28 having a predetermined surface roughness to operate as a crushing means is disposed above de-agglomeration chamber 9. The agglomerate block 8 is preferably crushed to a particle size of 5 to 20 microns, which is useful for the developing step. Since a second de-agglomeration means is disposed in de-agglomeration chamber 9, toner agglomerate may be crushed by rotating member 28 to a certain degree. For example, agglomerate can be crashed to lumps consisting several tens of particles to several hundreds of toner particles. When ultra-fine powder toner of less than several microns is obtained, the ultra-fine powder can be collected by of collection means of the type described in the one toner component system. Accordingly, rotating member 28 should have a surface roughness sufficient for cutting the agglomerate to produce particles of 0.5 to 1000 microns.

Under rotation member 28, rotating wings 29 are disposed in parallel with the member 28 in such a manner that the de-agglomerated toner powder is transferred to storage section 27. Wing 29 can be used as de-agglomeration means for de-agglomerating the lump which are not sufficiently crushed by the member 28.

Toner agglomerate 8 is held by pressing against rotation member 28 using toner agglomerate transfer member 21'. Compressed toner agglomerate is subjected to friction so as to be subjected to de-agglomeration, while the rotating member 28 rotates. Only toner having a particle size which is small enough to pass the mesh member 26 is transferred to the developing area. Clogging of the mesh member 26 can be avoided by applying vibration to the mesh member at a certain interval.

Only toner having a particle size that is possible to pass mesh member 26 is conveyed to developing agent storage section 27 immediately. A toner concentration detection means 30 is installed at the developing agent storage section 27. Based on the information received from detection means 30, toner is conveyed from toner de-agglomeration chamber 9 to developing agent storage section 27, whereby a predetermined toner concentration is maintained.

As in the developing unit employing a conventional two component toner developing system, there are installed in the developing agent storage section 27 a screw 31 for stirring and transferring the toner and a developing sleeve 33 operating as a developing agent bearing member having magnet roll 32. At the downstream side in the rotating direction of the developing sleeve 33, magnetic blade 34 serving as a regulation member is disposed. By rotation of the screw 31, the developing agent in developing agent storage section 27 is friction-charged, and developing is carried out with a magnetic brush.

With this developing unit 4, a printing test was performed. As a result, 95% or more of toner particles in developing storage section 27 was 8 to 11 microns, though 60% of the toner particles was coarse particles of 20 microns or more. The particle size of the fine toner particles was the same as that of the toner before agglomeration. The toner concentration in the developing agent was kept constant, and clear images could be obtained. The supply work of toner agglomerate 8 to supply means 13 was extremely easy and toner scattering did not occur.

In the developing unit used in the example of FIG. 4, when mesh member 26 operating as a classifying means was removed and the printing test was carried out in the same way, it was not possible to obtain stable images, because 60% of the toner was coarse particles of more than 20 microns in the developing agent. The construction of the developing unit according to this invention is not limited to the above examples. The construction of the supply means 13 for supplying toner agglomerate and the de-agglomeration chamber 9 can be changed in accordance with the shapes of the agglomerates and the status of toner particles constituting the agglomerates. Developing systems can use single component toner methods and the two component toner methods. As a carrier for the two component toner-system, such materials as iron powder, magnetic powder of ferrite or glass beads can be used. The surfaces of these materials can be treated with resins. As a de-agglomerator of the toner agglomerate 8, a comb-like form vibrator can be used.

Figure 5:
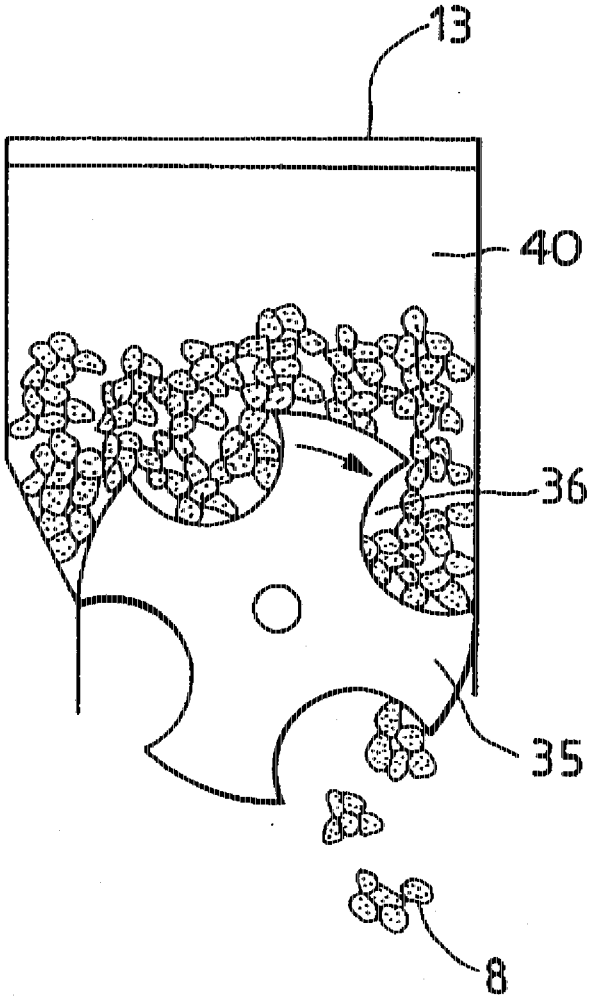
FIG. 5 is a diagram of an example of a toner agglomeration supply means.

As a supply means of the toner agglomerate in case of, a using a lump-form toner agglomerate 8, for example, supply means 13 of the toner agglomerate shown in FIG. 5 can be used. In the construction of FIG. 5, transfer member 21 for supplying toner agglomerate pellets comprises rotating body 35 having several storage compartments 36 for transferring a predetermined quantity of toner agglomerates from a storage section 40 for accommodating toner agglomerate.

The toner agglomerate 8 in storage section 40 fills compartments 36 as the rotating body 35 rotates, and is conveyed and transferred into de-agglomeration chamber 9. By this construction, it is possible to avoid enlargement of the developing unit, compared with conventional machines using powder toner, and it is also possible to realize a developing unit which is compact and easy to use.

What is claimed is:

1. A developing apparatus for an electrophotographic process which comprises:

a photoconductor;

a charger for uniformly charging the surface of the photoconductor;

an exposer for forming a latent electrostatic image on the surface of the charged photoconductor; and a developing unit for visualizing the latent electrostatic image by causing fine toner powder to adhere to the latent electrostatic image, wherein the developing unit comprises:

(a) de-agglomerate means for de-agglomerating toner agglomerate to form said fine toner powder, and (b) classifying means for classifying and selecting toner powder usable for development according to particle size.

2. The developing apparatus according to claim 1, wherein the toner agglomerate is a solid member.

3. A developing apparatus for an electrophotographic process which comprises:

a photoconductor;

a charger for uniformly charging the surface of the photoconductor;

an exposer for forming a latent electrostatic image on the charged surface of the photoconductor; and a developing unit for visualizing the latent electrostatic image by causing fine toner powder to adhere to the latent electrostatic image, wherein the developing unit comprises:

(a) supply means for supplying a toner agglomerate, (b) de-agglomerate means for de-agglomerating the toner agglomerate to form said fine toner powder, and (c) classifying means for classifying and selecting toner powder usable for development according to particle size.

4. The developing apparatus according to claim 3, wherein the toner agglomerate is a solid member.

5. The developing apparatus according to claim 3, wherein a void fraction $\epsilon(\%)$ is 5 to 80, where the void fraction is a volume of the toner agglomerate occupying a space per unit volume.

6. The developing apparatus according to claim 3, wherein a void fraction $\epsilon(\%)$ is 20 to 70, where the void fraction is a volume of the toner agglomerate occupying a space per unit volume.

7. The developing apparatus according to claim 3, wherein a void fraction $\epsilon(\%)$ is 40 to 60, where the void fraction is a volume of the toner agglomerate occupying a space per unit volume.

8. The developing apparatus according to claim 3, wherein the de-agglomeration means includes at least one rotating wing for crushing the toner agglomerate.

9. The developing apparatus according to claim 3, wherein said de-agglomeration means comprises a rotating member having a predetermined surface roughness and pressure means for biasing the toner agglomerate into contact with the rotating member.

10. The developing apparatus according to claim 3, wherein the developing unit operates in accordance with a non-magnetic one component toner method.

11. The developing apparatus according to claim 3, wherein the developing unit operates in accordance with a two component toner method utilizing a magnetic brush.

12. An electrophotographic process for an image forming apparatus which comprises the steps of:

preparing an agglomerate of toner powder;

supplying the agglomerate to a developing unit;

de-agglomerating the agglomerate in the developing unit to form fine toner powder; and classifying and selecting toner powder usable for development according to particle size.

13. The electrophotographic process according to claim 12, wherein the step of preparing an agglomerate of toner powder provides a solid member as the agglomerate of toner powder.

14. The electrophotographic process according to claim 12, wherein the developing unit is part of a developing apparatus including a photoconductor, a charger for uniformly charging the surface of the photoconductor, an exposer for forming a latent electrostatic image on the surface of the charged photoconductor, and the developing unit enables visualizing of the latent electrostatic image by causing fine toner powder to adhere to the latent electrostatic image.

15. The electrophotographic process according to claim 12, wherein the developing unit of the electrophotographic process includes a photoconductor, a charger for uniformly charging the surface of the photoconductor, an exposer for forming a latent electrostatic image on the surface of the charged photoconductor, and the developing unit enables visualizing of the latent electrostatic image by causing fine toner powder to adhere to the latent electrostatic image.

16. A developing apparatus for an electrophotographic process which comprises:

a photoconductor;

a charger for uniformly charging the surface of the photoconductor;

an exposer for forming a latent electrostatic image on the surface of the charged photoconductor; and a developing unit for visualizing the latent electrostatic image by causing fine toner powder to adhere the latent electrostatic image, wherein the developing unit comprises:

(a) de-agglomerate means for de-agglomerating toner agglomerate to form said fine toner powder, (b) classifying means for classifying and selecting toner powder usable for development according to particle size, and (c) collection means for collecting ultra-fine toner powder which was not classified and selected as toner powder usable for development in the developing apparatus.

17. A developing apparatus for an electrophotographic process which comprises:

a photoconductor;

a charger for uniformly charging the surface of the photoconductor;

an exposer for forming a latent electrostatic image on the surface of the charged photoconductor; and a developing unit for visualizing the latent electrostatic image by causing fine toner powder to adhere the latent electrostatic image, wherein the developing unit comprises:

(a) supply means for supplying a toner agglomerate, (b) de-agglomerate means for de-agglomerating toner agglomerate to form said fine toner powder, (c) classifying means for classifying and selecting toner powder usable for development according to particle size, and (d) collection means for collecting ultra-fine toner powder which was not classified and selected as toner powder usable for development in the developing apparatus.

18. An electrophotographic process for an imaging forming apparatus having a photoconductor, a charger for uniformly charging the surface of the photoconductor, an exposer for forming a latent electrostatic image on the surface of the charged photoconductor, and a developing unit for visualizing the latent electrostatic image by causing fine toner powder to adhere to the latent electrostatic image, the developing unit including de-agglomerate means for de-agglomerating toner agglomerate to form the fine toner powder, and classifying means for classifying and selecting toner powder usable for development according to particle size, the electrophotographic process including the steps of:

de-agglomerating the toner agglomerate to form the fine toner powder utilizing the de-agglomerate means; and classifying and selecting toner powder usable for development according to particle size utilizing the classifying means.

19. The electrophotographic process according to claim 18, further comprising the step of visualizing the latent electrostatic image by causing fine toner powder to adhere to the latent electrostatic image.

20. The electrophotographic process according to claim 18, wherein the toner agglomerate is a solid member.

21. An electrophotographic process for an image forming apparatus having a photoconductor, a charger for uniformly charging the surface of the photoconductor, an exposer for forming a latent electrostatic image on the surface of the charged photoconductor, and a developing unit for visualizing the latent electrostatic image by causing fine toner powder to adhere to the latent electrostatic image, the developing unit including supply means for supplying a toner agglomerate, de-agglomerate means for de-agglomerating the toner agglomerate to form the fine toner powder, and classifying means for classifying and selecting toner powder usable for development according to particle size, the electrophotographic process comprising the steps of:

supplying toner agglomerate utilizing the supply means;

de-agglomerating the toner agglomerate to form the fine toner powder utilizing the de-agglomerate means; and classifying and selecting the toner powder usable for development according to particle size utilizing the classifying means.

22. The electrophotographic process according to claim 21, further comprising the step of visualizing the latent electrostatic image by causing the fine toner powder to adhere to the latent electrostatic image.

23. The electrophotographic process according to claim 21, wherein the toner agglomerate is a solid member.

24. The electrophotographic process according to claim 21, wherein a void fraction $\epsilon(\%)$ is 5 to 80, where the void fraction is a volume of the toner agglomerate occupying a space per unit volume.

25. The electrophotographic process according to claim 21, wherein a void fraction $\epsilon(\%)$ is 20 to 70, where the void fraction is a volume of the toner agglomerate occupying a space per unit volume.

26. The electrophotographic process according to claim 21, wherein a void fraction $\epsilon(\%)$ is 40 to 60, where the void fraction is a volume of the toner agglomerate occupying a space per unit volume.

27. The electrophotographic process according to claim 21, wherein the step of de-agglomerating means includes at least one rotating wing for crushing the toner agglomerate.

28. The electrophotographic process according to claim 21, wherein the de-agglomeration means comprises a rotating member having a predetermined surface roughness and pressure means for biasing the toner agglomerate into contact with the rotating member.

29. The electrophotographic process according to claim 21, wherein the developing unit operates in accordance with a non-magnetic one component toner method.

30. The electrophotographic process according to claim 21, wherein the developing unit operates in accordance with a two component toner method utilizing a magnetic brush.

* * * * *